United States Patent [19]

Finke

[11] Patent Number: 4,520,938

[45] Date of Patent: Jun. 4, 1985

[54] SAFETY SCREW CAP

[75] Inventor: Robert G. Finke, Finnentrop, Fed. Rep. of Germany

[73] Assignee: Robert Finke GmbH, Finnentrop, Fed. Rep. of Germany

[21] Appl. No.: 273,021

[22] Filed: Jun. 12, 1981

[30] Foreign Application Priority Data

Jun. 14, 1980 [DE] Fed. Rep. of Germany ..... 3022465

[51] Int. Cl.[3] ..... B65D 55/02

[52] U.S. Cl. ..... 215/220

[58] Field of Search ..... 215/219, 220, DIG. 1

[56] References Cited

U.S. PATENT DOCUMENTS 3,722,727 3/1973 Gach ..... 215/220
3,912,101 10/1975 Rayner et al. ..... 215/220
3,968,894 7/1976 Herrmann ..... 215/220
4,241,840 12/1980 Willis ..... 215/220

*Primary Examiner*—George T. Hall
*Attorney, Agent, or Firm*—Toren, McGeady and Stanger

[57] ABSTRACT

A safety screw cap is made up of an inner cap arranged to be screwed onto the neck of a bottle and an outer cap forming a cover over the inner cap. A cam is formed on one of the end closing walls of the inner cap or the outer cap spacing them apart in the assembled position. Perforations are formed in the end closure wall of the outer cap providing it with flexibility so that it can be forced axially toward the inner cap whereby the screw cap assembly can be removed from the closed or sealed condition. Because of the cam extending between the end closure walls, when axial force is exerted on the outer cap the end closure wall of that cap assumes an arched configuration as the screw cap assembly is removed.

15 Claims, 5 Drawing Figures

SAFETY SCREW CAP

SUMMARY OF THE INVENTION

The present invention is directed to a safety screw cap for bottles and similar containers and is made up of a threaded inner cap arranged to be screwed onto the container and an outer cap forming a cover over the inner cap.

Safety screw caps arranged to prevent a young child from opening a container and gaining access to its contents, which might be dangerous to the child, are known, such child-proof packaging must assure a required degree of safety.

In West German Gerbrauchsmuster No. 7 534 340 a child-proof pressure screw cap is disclosed made up of an inner cap and an outer cap. An outward projection is formed on the inner cap and a corresponding inward projection is formed on the outer cap with the caps arranged so that the outer cap can be turned relative to the inner cap without turning the inner cap. On the outer surface of the end closure wall of the inner cap, a stop is located which can interact with a take-along member located on the inner surface of the end closure wall of the outer cap. Between the end closure wall of the two caps a pressure spring is positioned which spaces the two end closure walls apart by a dimension assuring that the stop and the take-along member do not interengage when the outer cap is turned. If pressure is applied to the outer cap in the axial direction of the screw cap assembly toward the inner cap, the spring is compressed with the take-along member moving toward and into contact with the stop on the inner cap. When these two parts engage, by turning the outer cap, the inner cap can be screwed off a container.

In another child-proof screw cap for bottles disclosed in West German Gebrauchsmuster No. 7 634 267, an outwardly extending encircling ring shoulder is formed near the open end of the inner cap and ribs are formed on the outer surface of the inner cap extending in the axial direction from this shoulder toward the end closure wall of the cap. These outside ribs have a short axial length and form an encircling rib ring on the outside surface of the inner cap.

Corresponding inner ribs are formed on the inside surface of the outer cap and extend from the end closure wall of the cap to a short distance from the open end of that cap. To interengage the ribs on both caps axial pressure is exerted against the outer cap in the direction of the inner cap. Spring elements are arranged on the inside surface of the end closure wall of the outer cap and bear against the opposed outside surface of the end closure wall of the inner cap and assure that the ribs on the outer cap are spaced out of engagement with the rib ring on the inner cap when the cap assembly is in the closed condition. This known cap assembly can be opened by pressing the outer cap in the axial direction toward the inner cap against the spring biasing force and at the same time turning the outer cap about the axis of the cap assembly. The screw cap assembly can be turned as a unit only when the inner ribs on the outer cap interengage with the rib ring on the inner cap, if there is no interengagement, the lower ends of the ribs on the outer cap slide over the rib ring and do not interengage.

Another safety screw cap has been proposed consisting of an inner cap with an inner thread and an outer cap covering the inner cap. The interconnection of the two caps is provided by axially extending ribs on the outside of the inner cap and corresponding to axially extending ribs on the inner surface of the outer cap. The ribs on the inner cap have sloping ends facing toward the end closure wall of the cap with the sloping surfaces inclined downwardly in the screwing-on direction for right-hand threads. Similarly, the ribs on the outer cap on the ends facing away from the end closure wall have sloping surfaces inclined upwardly in the screwing-off direction. Accordingly, a safety screw cap is provided with the inclined surfaces on the ribs of the inner and outer caps based a short distance apart in the closed or sealed condition of the screw cap and, by a slight axial displacement of the outer cap toward the inner cap, the inclined surfaces on the ribs can be interengaged so that the cap can be opened by turning the outer cap.

Therefore, the primary object of the present invention is to provide a safety screw cap for bottles and similar containers which is easier to handle and, in particular, provides a simple, durable and fatigue-proof spring action between the two caps of the screw cap assembly. The invention is particularly directed to a safety screw cap in which the inner cap has axially extending outside ribs and the outer cap has corresponding axially extending inside ribs so that, with a slight axial displacement of the outer cap toward the inner cap and simultaneous turning of the outer cap, removal of the screw cap is possible without the necessity of interengaging the take-along elements over a greater height or axial range of the screw cap assembly.

In accordance with the present invention, the end closure wall of the outer cap is provided with perforations.

Accordingly, the safety screw cap is provided with a simple, durable and fatigue-free spring action between the two caps. In this arrangement, the flexibility of the end closure wall of the outer cap is such that the cap can be moved effortlessly in the axial direction relative to the inner cap though the outer cap is made of a comparatively rigid and inelastic material such as plastics material parts manufactured in the injection molding process. As a result, the use of additional springs and/or spring connections formed of plastics material are unnecessary so that the production and storage of the safety screw cap is facilitated. Perforations in the form of laterally closed surfaces and/or elongated perforations with narrow webs connecting the opposite sides of the perforation can be formed in the outer cap. The webs are formed of the same material as the outer cap. Such an arrangement of the perforations favorably influences the elasticity of the end closure wall of the outer cap without weakening it to any great extent. The perforations can be formed in the shape of simple directional markings.

In accordance with another feature of the present invention, the outer cap and the inner cap can be made of different colors. Such color differences enhance the contrast of the perforations relative to the surface of the outer cap. Such contrast simplifies the recognition of the information represented by the form of the perforations. With such a two-color contrast scheme, it is possible to recognize from a considerable distance whether the outer cap rests on the inner cap. Each of the caps can have different color schemes, since it is important only that the respective outer configurations of the two caps are colored differently.

In a particularly advantageous embodiment, either the inside surface of the end closure wall of the outer cap or the outside surface of the end closure wall of the inner cap is provided with a spacing cam. This cam, in combination with the perforated end closure wall of the outer cap, assures that the spring action is attained in a favorable manner with the frictional engagement between the two caps being neither too great nor too small when the outer cap is turned relative to the inner cap. The spacing cam can have a great variety of shapes and it can be formed integrally with one of the caps.

It is particularly advantageous if the spacing cam is centered in the middle of the end closure wall, that is on the axis of the screw cap so that the axial displacement of the outer cap relative to the inner cap can be obtained with the slightest application of force.

As long as the outer cap of the screw cap assembly has an inwardly directed projection at its open end overlapping an outwardly directed projection on the outside surface of the inner cap, the outer cap can have additional inwardly directed projections on its inside surface between the projection at the open end and the end closure wall. These additional projections can extend around the inside surface of the outer cap as a continuous shoulder or ridge or in the form of individual projections spaced apart from one another but arranged in a ring-like manner. These additional projections should not project inwardly as far as the projection located at the open end of the outer cap. The additional projections provide an effective guidance, relatively free of friction, of the outer cap about the inner cap. The same purpose can be achieved by the use of a recess in the surface of the end closure wall of one of the caps opposite the spacing cam on the other cap with the cam fitting into surface contact with the recess.

Finally, the inside surface of the end closure wall has a sealing insert with at least two lips extending circumferentially and in parallel relation. When the screw cap is threaded onto a container into the closed position, the lips yield slightly during the final tightening of the screw cap and afford an effective sealing action with only a slight amount of force. Further, the interengaging means on the inner cap and outer cap are subjected to less mechanical stress.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
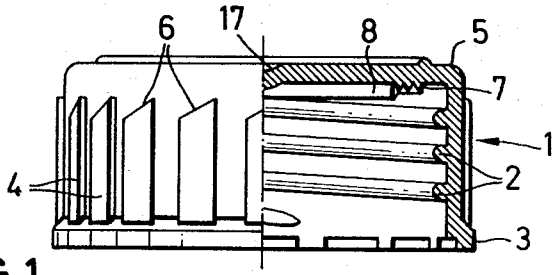
FIG. 1 is an elevational view, partly in section, illustrating the inner cap of a screw cap embodying the present invention.

The safety screw cap of the present invention consists of an inner cap 1 and an outer cap 9. Each of the caps has an axially extending annular side wall and an end closure wall extending transversely across and forming a closure for one end of the side wall. In FIG. 1 inner cap 1 is illustrated and it has an inner thread 2 on its annular side wall and a ring projection 3 extending outwardly from the outside surface of the annular side wall at the open end of the cap. Ribs 4 are formed on the outside surface of the inner cap and extend from the ring projection 3 toward but stop short of the end closure wall 5 of the cap. The space between the end closure wall 5 and the adjacent ends of the ribs 4 is relatively small. At the ends of the ribs 4 adjacent the end closure wall, inclined surfaces 6 are provided and these surfaces incline downwardly in the closing direction of a right-hand thread, that is, in the screwing-on direction.

The outer ribs 4 have a rectangular or trapezoidally shaped cross-section with the surfaces leading in the direction of a right-hand thread in the screwing-on direction being bevelled. Further, the inside surface of the end closure wall 5 has a circular sealing insert 8 with a number of lips 7 extending around its outer circumferential edge and with the lips disposed in parallel.

Figure 2:
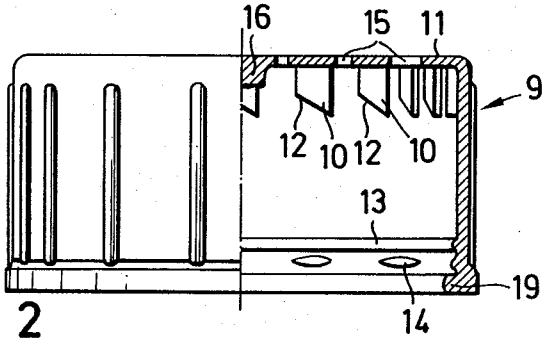
FIG. 2 is an elevational view, partly in section, displaying the outer cap of the screw cap shown in FIG. 1.
Figure 5:
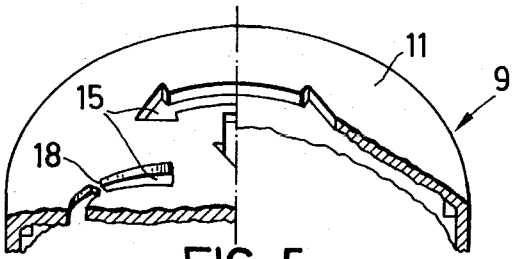
FIG. 5 is a partial broken-away view of the outer cap with perforations therein shown in the form of arrows.

Outer cap 9 is shown in FIGS. 2 and 5 and it has an annular projection 19 extending inwardly from the open end of the cap, that is, the lower end of the annular side wall so that in the assembled condition of the safety screw cap it overlaps the projection 3 on the inner cap 1. Inner ribs 10 are formed on the inside surface of the side wall of the outer cap 9 and extend in the axial direction from the inside surface of the end closure wall 11 for a short distance toward the open end of the cap. These inner ribs 10 are relatively short and have inclined surfaces 12 at the ends spaced from the end closure wall 11. These inclined surfaces 12 are inclined upwardly in right-hand threads in the opening direction, that is, in the screwing-off direction. The ribs 10 of the outer cap 9 have a rectangular cross-section. On the inside surface of the annular side wall of the outer cap 9, between the projection 19 and the end closure wall 11, additional inward projections 13, 14 are provided. Projection 13 is ring-shaped and extends parallel to and spaced from the projection 19. Projections 14, however, are individual projections spaced apart in a ring around the inside surface and disposed in spaced relation between the projections 13 and 19. The dimension of the projections 13, 14 in the axial direction of the cap is less than the comparable axial dimension of the projection 19. In FIGS. 2 and 5, perforations 15 are shown extending through the end closure wall 11 of the outer cap 9. These perforations are spaced radially outwardly from the axial center of the the outer cap and are in the form of curved arrows. The perforations are defined by laterally closed surfaces. As can be seen in the left-hand part of FIG. 5, a generally radially extending web 18 connects the opposite long sides of the arrow-shaped perforation 15. The web 18 is formed of the same material as the remainder of the outer cap.

Figure 3:
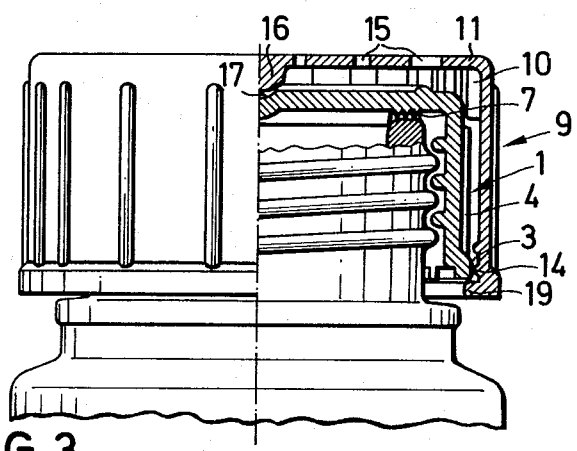
FIG. 3 is an elevational view, partly in section, showing the assembled safety screw cap threaded onto the neck of a bottle with the inner cap and outer cap displayed in the closed or sealed condition on the bottle.
Figure 4:
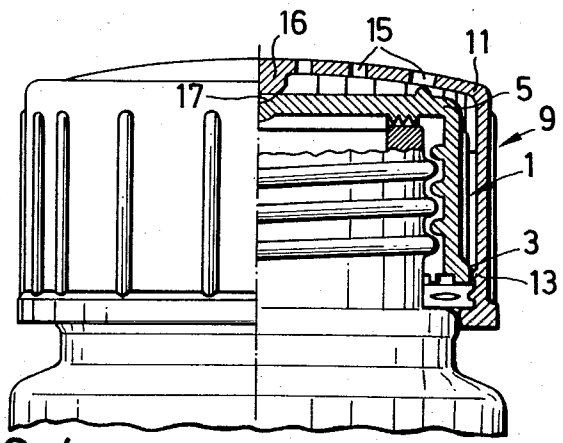
FIG. 4 is a view similar to FIG. 3 but with the outer cap displaced from the closed condition into the opening condition.

In FIGS. 2, 3 and 4 it can be noted that a spacing cam 16 is formed integrally with and extends inwardly from the inside surface of the end closure wall 11 of the outer cap. The spacing cam is located on the axial center of the end closure wall 11. Opposite the cam 16, in the outside surface of the end closure wall 5 of the inner cap, is a recess 17. As can be seen in FIG. 1 the recess 17 has a rounded surface. The end of cam 16 spaced from the end closure wall 11 abuts lightly against the surface of the recess 17.

In FIG. 3, the outer cap 9 is fitted over the inner cap 1 with its projection 19 located below and in contact with the open end of the inner cap 1 and with its projections 14 resting lightly against the outwardly directed projection 3 on the inner cap 1. In FIG. 3 the screw cap is in the closed or sealed condition without any axial force being applied on the outer cap 9 against the inner cap 1. By contrast, in FIG. 4, the outer cap 9 has been displaced axially relative to the inner cap 1 with its ring-shaped projection 13 resting lightly against the outwardly directed projection 3 on the inner cap so that the end closure wall 11 adopts an arched or dome-like configuration. This arched configuration results from the flexibility provided the end closure wall 11 by the perforations 15. Because of the perforations 15, the end closure wall 11 is more elastic than the end closure wall 5 of the inner cap with the spacing cam 16 maintaining the original spacing between the two end closure walls while the radially outer surface of the end wall 11 moves toward the inner cap providing the arched configuration.

As mentioned above, it can be seen in FIG. 5 how the generally radially extending web 18 extends between the longer sides of the perforations 15.

To provide a closure for a bottle, the upper neck portion of which is illustrated in FIGS. 3 and 4, so that a young child cannot open the bottle, the inner cap 1 is screwed onto the neck of the bottle in the usual manner. Next, the outer cap 9 is forced down over the inner cap 1 and the inwardly directed ring-like projection 19 on the outer cap is forced over the outwardly directed projection 3 on the inner cap with the inwardly directed projection 19 located below the outwardly directed projection 3 preventing the outer cap from being pulled off the inner cap without the aid of special tools. In the position illustrated in FIG. 3, the safety screw cap is in the closed or sealed condition with the shorter inner ribs 10 on the outer cap being spaced upwardly from the ends of the longer outer ribs 4 on the inner cap. In this position, spacing cam 16 on the outer cap fits into contact with the surface of the recess 17 in the end closure wall 5 of the inner cap 1. In this closed condition, the outer cap can be turned around the safety cap axis in both directions and the frictional contact between the caps is so slight that the inner cap cannot be detached or screwed off from the neck of the bottle merely by turning or rotating the outer cap.

To remove the safety cap, initially an axially directed force or pressure is exerted on the outer cap toward the inner cap and the spacing between the juxtaposed surfaces of the end closure walls of the tube caps becomes smaller in their radially outer areas adjacent the circumferential edge. As can be seen in FIG. 4, the inclined surfaces 12 on the ribs 10 of the outer cap 9 contact the inclined surfaces 6 on the ribs 4 of the inner cap and transmit a turning or screwing-off movement to the inner cap 1. In the opening condition of the safety screw cap shown in FIG. 4 the caps can be removed from the neck of the bottle. Further, the inner cap 1 and the outer cap 9 can be placed back on the bottle as a unit. The assembled caps are placed on the neck of the bottle with the thread 2 of the inner cap 1 engaging the outer thread of the bottle and by turning the assembly slightly in the closing direction. Though the frictional engagement is slight between the spacing cam 16 and the surface of the recess 17 on one hand and between the outwardly directed projection 3 of the inner cap and the individual projections 14 on the outer cap, there is sufficient engagement to effect a light screwing-on of the inner cap. This connection of the cap on the bottle is reinforced by means of the slight prestress afforded by the spacing cam extending between the end closure walls of the two caps. To provide a tight closure of the screw cap on the bottle, a downwardly directed axial force is applied to the outer cap 9 similar to the force exerted when the cap is removed. If, at the same time, the outer cap 9 is turned around the central axis, the straight ridges of the inner ribs of the outer cap 9 and of the outer ribs 4 of the inner cap 1 abut against one another in a force-locking manner so that the turning moment exerted on the outer cap 9 is transmitted to the inner cap 1 and the inner cap can be tightly closed onto the bottle. Depending on the magnitude of the force exerted in screwing-on the caps onto the bottle, the lips 7 of the sealing insert 8 yield to a degree depending on the force exerted and prevent any destruction of the cap because of the use of too great a force in effecting the closure. Further, the arrangement of the sealing insert and its sealing lips 7 provides an especially effective sealing seat on the bottle neck.

While specific embodiments of the invention have been shown and described in detail to illustrate the application of the inventive principles, it will be understood that the invention may be embodied otherwise without departing from such principles.

I claim:

1. Safety screw cap comprising an inner cap arranged to be secured onto the neck of a bottle and having an axially extending annular side wall and an end closure wall extending transversely across and forming a closure for one end of said side wall, said side wall having an inner surface with a thread formed thereon for engagement with a corresponding thread on the neck of the bottle, an outer cap forming a cover over said side wall and end closure wall of said inner cap, said outer cap having an axially extending annular side wall and an end enclosure wall extending transversely across and forming a closure for one end of said side wall, wherein the improvement comprises that said end closure wall of said outer cap has flexibility improving perforations extending therethrough with each said perforation having the shape of a laterally closed space.

2. Safety screw cap, as set forth in claim 1, wherein said perforations having a pair of oppositely disposed elongated surfaces, and a narrow web extending across and interconnecting said elongated surfaces intermediate the opposite ends thereof.

3. Safety screw cap, as set forth in claim 2, wherein said perforations are located radially outwardly from the axial center of said end closure wall and inwardly of the radially outer circumferential edge of said end closure wall.

4. Safety screw cap, as set forth in claim 3, wherein said perforations having an arrow-shaped configuration in the plane of said end closure wall of said outer cap.

5. Safety screw cap, as set forth in claims 1, 2, 3 or 4, wherein each of said outer cap and inner cap is formed of a different color.

6. Safety screw cap, as set forth in claims 1, 2, 3 or 4, wherein at least one spacing cam extends between the facing surfaces of said end closure walls of said inner and outer caps.

7. Safety screw cap, as set forth in claim 6, wherein said spacing cam is arranged on the axial center of said end closure wall.

8. Safety screw cap, as set forth in claim 7, wherein said spacing cam is formed on one of said end closure walls of said inner and outer caps and a recess is formed on the other one of said end closure walls of said inner and outer caps with said recess aligned with said spacing cam so that said spacing cam abuts against the surface of said recess and the remaining surface of said end closure wall containing said spacing cam is planer.

9. Safety screw cap, as set forth in claims 1, 2, 3 or 4, wherein a spacing cam is formed integrally with and extends outwardly from said end closure wall of said outer cap toward said end closure wall of said inner cap.

10. Safety screw cap, as set forth in claim 9, wherein said spacing cam is located on the axial center of said end closure wall of said outer cap.

11. Safety screw cap, as set forth in claim 10, wherein the surface of said end closure wall of said inner cap facing toward said outer cap has a recess formed therein in alignment with said spacing cam on said outer cap so that said spacing cam fits into surface contact with said recess.

12. Safety screw cap, as set forth in claims 1, 2, 3, or 4, wherein an annular shaped inwardly directed projection is formed at the end of said side wall of said outer cap spaced from said end closure wall, an outwardly directed annular projection formed on the outer surface of said side wall of said inner cap at the end thereof spaced from said end closure wall thereof and said wall of said outer cap having a longer axial dimension than said side wall of said inner cap so that said inwardly directed projection fits downwardly over said outwardly directed projection in the assembled safety screw cap, and at least one additional inwardly directed projection formed on the inner surface of said side wall of said outer cap spaced between said inwardly directed projection at the end of said surface space from said end closure wall thereof and said end closure wall.

13. Safety screw cap, as set forth in claim 12, wherein said additional elevations on the inner surface of said side wall of said outer cap include a ring-shaped inwardly directed projection spaced axially from said inwardly directed projection at the end of said inner surface of said side wall of said outer cap and a plurality of individual inwardly directed projections spaced apart around the inside surface of said side wall of said outer cap between said other two projections thereon.

14. Safety screw cap, as set forth in claims 1, 2, 3 or 4, wherein a circular sealing insert is formed on the inside surface of said end closure wall of said inner cap and said sealing insert includes at least a pair of lips disposed in parallel relation and extending around the outer circumferential edge thereof.

15. Safety screw cap, as set forth in claims 1, 2, 3 or 4, wherein said outer cap comprises a rigid plastics material formed in an injection molding process and said perforations located in said outer cap provide said outer cap with flexibility so that it adapts an arch-shaped configuration when said outer cap is pressed in the axial direction toward said inner cap.

* * * * *